US006459871B2

(12) United States Patent
Kwak et al.

(10) Patent No.: US 6,459,871 B2
(45) Date of Patent: Oct. 1, 2002

(54) PHOTOSENSITIVE BELT CARTRIDGE OF ELECTROPHOTOGRAPHIC IMAGE FORMING APPARATUS AND PHOTOSENSITIVE BELT INSTALLATION DEVICE AND METHOD EMPLOYING SAME

(75) Inventors: Jin-geun Kwak; Yong-su Kim, both of Yongin (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/794,165

(22) Filed: Feb. 28, 2001

(30) Foreign Application Priority Data

Jul. 8, 2000 (KR) ..... 00-39092

(51) Int. Cl.[7] ..... G03G 15/00
(52) U.S. Cl. ..... 399/116; 399/162; 206/303
(58) Field of Search ..... 399/116, 162; 206/303, 53, 389

(56) References Cited

U.S. PATENT DOCUMENTS 4,811,839 A * 3/1989 Cornell et al. ..... 206/303
5,119,133 A * 6/1992 Swain ..... 399/163
6,014,535 A * 1/2000 Zenk et al. ..... 399/116
6,097,912 A * 8/2000 Watson et al. ..... 399/116

* cited by examiner

*Primary Examiner*—Joan Pendegrass
(74) *Attorney, Agent, or Firm*—Sughrue Mion, PLLC

(57) ABSTRACT

A photosensitive belt installation device of an electrophotographic image forming apparatus that includes a soft cartridge which rolls up for storage, and an installation guide member which selectively attaches to the image forming apparatus. When unrolled, the cartridge, allows the simple installation of a photosensitive belt into the imaging forming apparatus. The soft cartridge is a flexible cartridge having a shape of the endless track of a belt unit of the imaging forming apparatus, and is open on both sides. The unrolled soft cartridge supports the photosensitive belt during installation, as one open side of the soft cartridge is fitted over a sloping surface of the installation guide member attached to the front frame of the belt unit. The soft cartridge is completely pushed around the belt unit along a sloping surface of the installation guide member. The photosensitive belt remains around the belt unit as the soft cartridge is pulled out. The installation guide member is then be removed from the front of the belt unit.

17 Claims, 8 Drawing Sheets

PHOTOSENSITIVE BELT CARTRIDGE OF ELECTROPHOTOGRAPHIC IMAGE FORMING APPARATUS AND PHOTOSENSITIVE BELT INSTALLATION DEVICE AND METHOD EMPLOYING SAME

BACKGROUND OF THE INVENTION

1. Field of the Invention

The present invention relates to a photosensitive belt cartridge for keeping a photosensitive belt to be installed in an electrophotographic image forming apparatus, and a photosensitive belt installation device and method employing the same. Korean Patent Application No. 00-39092, filed Jul. 8, 2000, is incorporated herein in its entirety by reference.

2. Description of the Related Art

As shown in FIG. 1, an electrophotographic image forming apparatus such as a color laser printer includes a photosensitive belt 10 circulating around a continuous loop while supported by a plurality of rollers 11, 12, and 13 installed in a main body of the image forming apparatus. On one surface of the photosensitive belt 10, an image to be printed is developed by a developing unit 15, and the developed image is dried while passing by a drying unit 16, and then is printed on a paper sheet at a transfer unit 14 including a transfer roller 14*a* and a fuser roller 14*b*. Here, the unit around which the photosensitive belt 10 circulates is called a belt unit.

However, as such a photosensitive belt 10 is used for a long time, a developed image gradually deteriorates in its precision. Therefore, when the photosensitive belt 10 reaches the end of its usable life, the photosensitive belt 10 must be replaced with a new one to continue to develop a neat image. However, in order to replace the photosensitive belt 10 in a conventional method, the photosensitive belt 10 is replaced by fitting it directly by hand in its installation position within the main body of the apparatus. In this method, one 13 of the plurality of rollers 11, 12, and 13 is installed to be movable as shown in dotted lines in FIG. 1, and when replaced, the photosensitive belt 10 is loosened by moving the roller 13 to the position shown in dotted lines, and then is removed from its installation position by hand. Subsequently, after a new photosensitive belt is inserted into its installation position by hand, the new photosensitive belt is tensioned by moving the roller 13 to its original position.

However, since the shape of the endless photosensitive belt 10 is not a rigid patterned shape, and the endless photosensitive belt 10 is as flexible as paper, there are problems in that to replace the photosensitive belt 10 by fitting it in place by hand is bothersome and difficult in itself, and, in addition, the photosensitive belt 10 may be erroneously installed depending upon a worker who performs the replacing job.

Therefore, to solve those problems, a cartridge 20 for receiving such a photosensitive belt 10 as shown in FIG. 2 has been proposed. The main body of the photosensitive belt cartridge 20 is comprised of a hard case having a shape similar to the endless track of the belt unit, and leaf springs 21 installed at the inner circumferential surface of the cartridge 20 and supporting the photosensitive belt 10 in a continuous loop state (i.e., in a state as the photosensitive belt 10 is installed around the belt unit). Reference symbol S denotes spare space provided so that the roller 13 can be moved to tension the photosensitive belt 10 when the photosensitive belt 10 is installed around the belt unit. Therefore, when the photosensitive belt 10 is installed, the cartridge 20 receiving the photosensitive belt 10 is pushed on, in the direction of arrow "A," around the belt unit within the image forming apparatus. When the roller 13 is moved as much as the spare space (S) as shown in FIG. 3, the photosensitive belt 10, supported by the leaf springs 21, is tightly tensioned. At this time, when the cartridge 20 is pulled back toward the outside, only the photosensitive belt 10 remains around the belt unit.

When the above hard-case cartridge 20 is used, the photosensitive belt 10 can be conveniently installed as described above. However, it is a problem to store the cartridge 20. That is, since the cartridge 20 has nearly the same shape as that of the belt unit around which the photosensitive belt 10 circulates in an endless belt state, the volume of the cartridge is larger than the belt unit, and there is no way to reduce the volume any more due to the hard case of the cartridge 20. Therefore, although the photosensitive belt 10 can be safely stored, and be easily installed, it is troublesome to store the cartridge 20.

SUMMARY OF THE INVENTION

To solve the above problem, it is an objective of the present invention to provide a photosensitive belt cartridge adapted to occupy small space during storage, and to be used in replacing a photosensitive belt in a convenient and fast manner, and a photosensitive belt installation device and method employing the same.

Accordingly, to achieve the above objective, there is provided a photosensitive belt cartridge of an electrophotographic image forming apparatus including: a soft cartridge which has the endless track shape of a belt unit of the image forming apparatus, which receives a photosensitive belt therein in the endless track shape, which can be rolled up with the photosensitive belt received therein, and which has flexibility so that the rolled-up soft cartridge can be restored back to its original shape when an external force is removed; and a hard cartridge in which the soft cartridge is stored in a rolled-up state.

In addition, there is provided a photosensitive belt installation device of an electrophotographic image forming apparatus for assisting in the installation of a photosensitive belt around a belt unit within the image forming apparatus comprising: an installation guide member which is attached to a front frame of the belt unit when the photosensitive belt is installed, and which has a sloping surface gradually enlarging in a direction from the outside of the image forming apparatus to the belt unit; and a soft cartridge in which the photosensitive belt to be installed around the belt unit is supported by predetermined restricting means in the endless track shape. The soft cartridge is a flexible cartridge having a shape of the endless track of the belt unit, and is open on both sides. The soft cartridge is shaped so that one open side of the soft cartridge fits over the sloping surface of the installation guide member. The soft cartridge is completely pushed around the belt unit along the sloping surface, and, then, the soft cartridge is pulled out and the photosensitive belt is freed from the restricted state by the restricting means, with the photosensitive belt formerly received in the soft cartridge remaining around the belt unit.

In addition, there is provided a photosensitive belt installation method of an electrophotographic image forming apparatus for installing a photosensitive belt around a belt unit within the image forming apparatus including the steps of: preparing a soft cartridge which is a flexible cartridge having a shape of the endless track of the belt unit, which is open on both sides, and in which the photosensitive belt to be installed around the belt unit is supported by predetermined restricting means in the endless track shape; installing an installation guide member which has a sloping surface gradually enlarging in a direction from the outside of the image forming apparatus to the belt unit at the front frame of the belt unit; fitting one open side of the soft cartridge to the sloping surface of the installation guide member, and completely pushing the soft cartridge around the belt unit along the sloping surface; and causing the photosensitive belt received in the soft cartridge to remain around the belt unit by pulling out the soft cartridge from the image forming apparatus after the photosensitive belt is freed from the restricted state by the restricting means.

BRIEF DESCRIPTION OF THE DRAWINGS

The above objective and advantage of the present invention will become more apparent by describing in detail preferred embodiments thereof with reference to the attached drawings in which.

Figure 1:
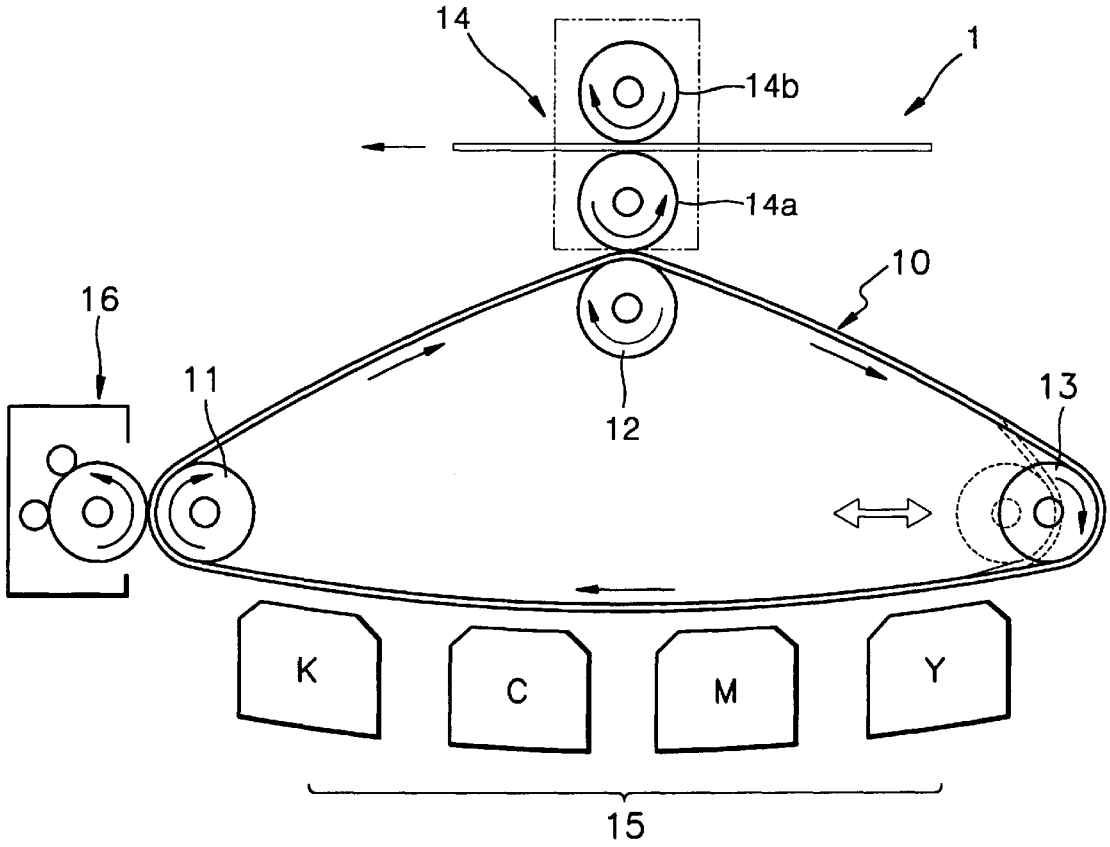
FIG. 1 (PRIOR ART)
FIG. 1 is a schematic diagram illustrating essential portions of a general electrophotographic image forming apparatus.
Figure 2:
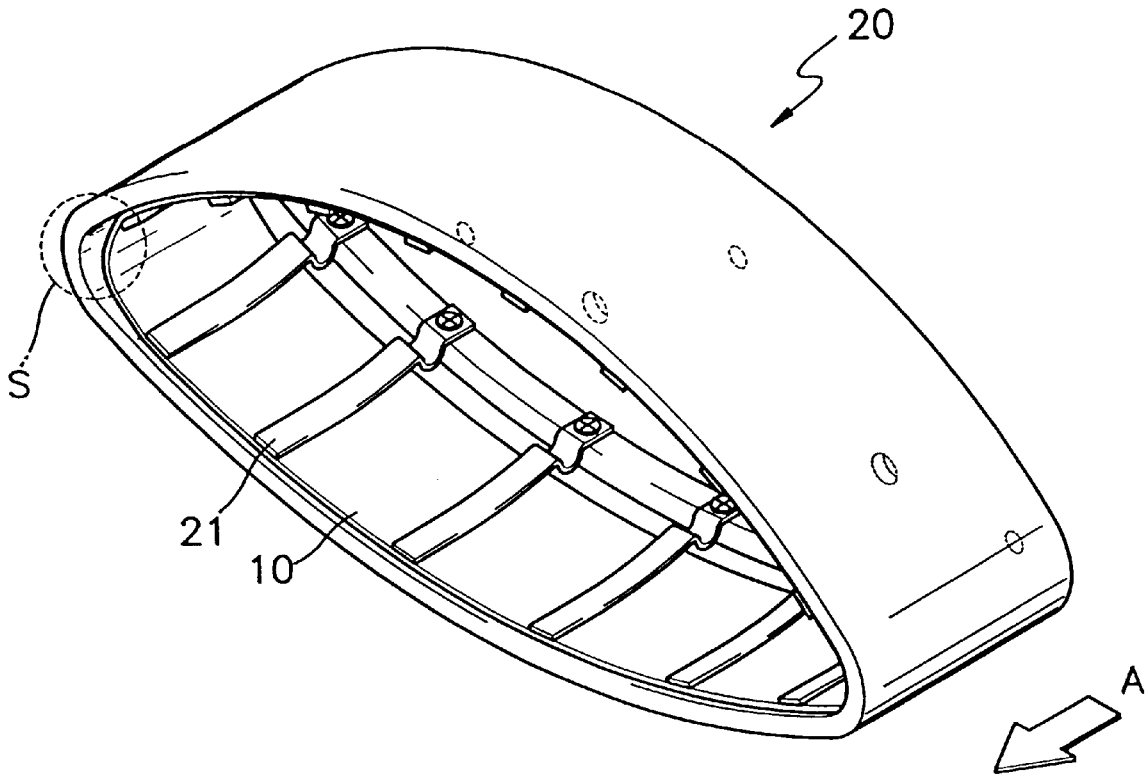
FIG. 2 (PRIOR ART)
FIGS. 2 and 3 perspective and front views illustrating a conventional cartridge for storing and installing a photosensitive belt.
Figure 3:
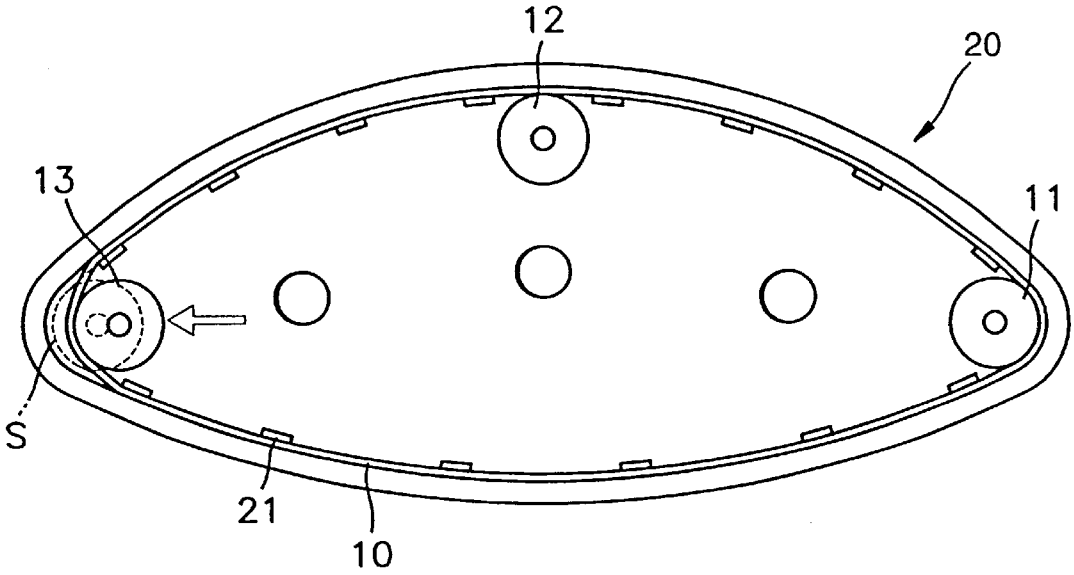
(PRIOR ART) FIG. 3
Figure 4:
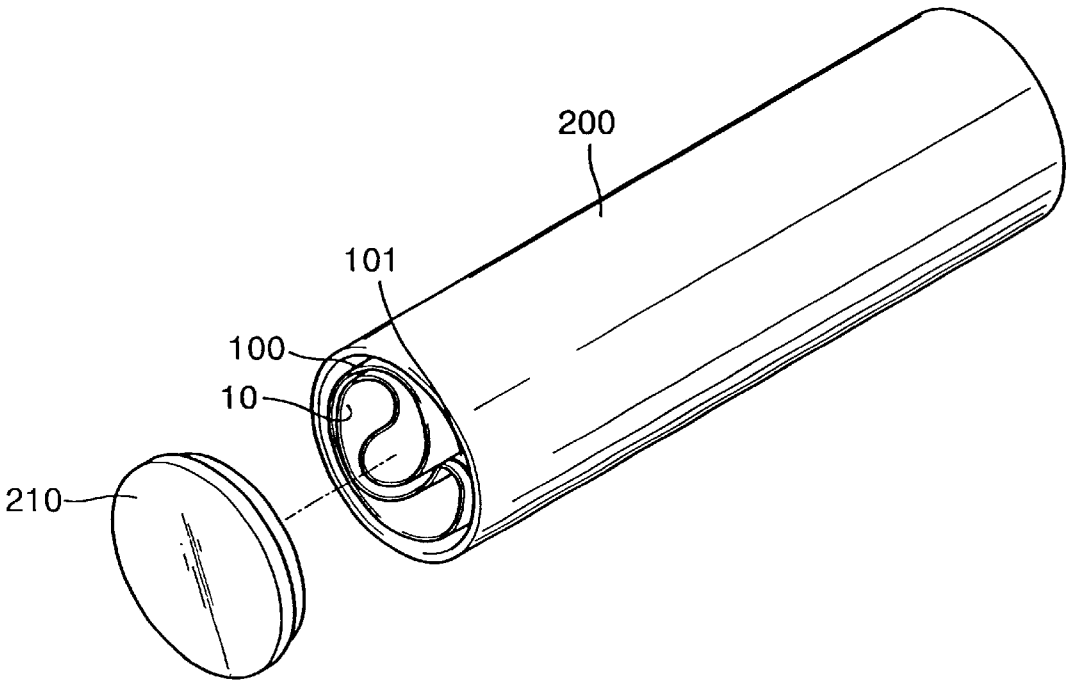
FIG. 4 is a perspective view illustrating a photosensitive belt cartridge according to the present invention.
Figure 5:
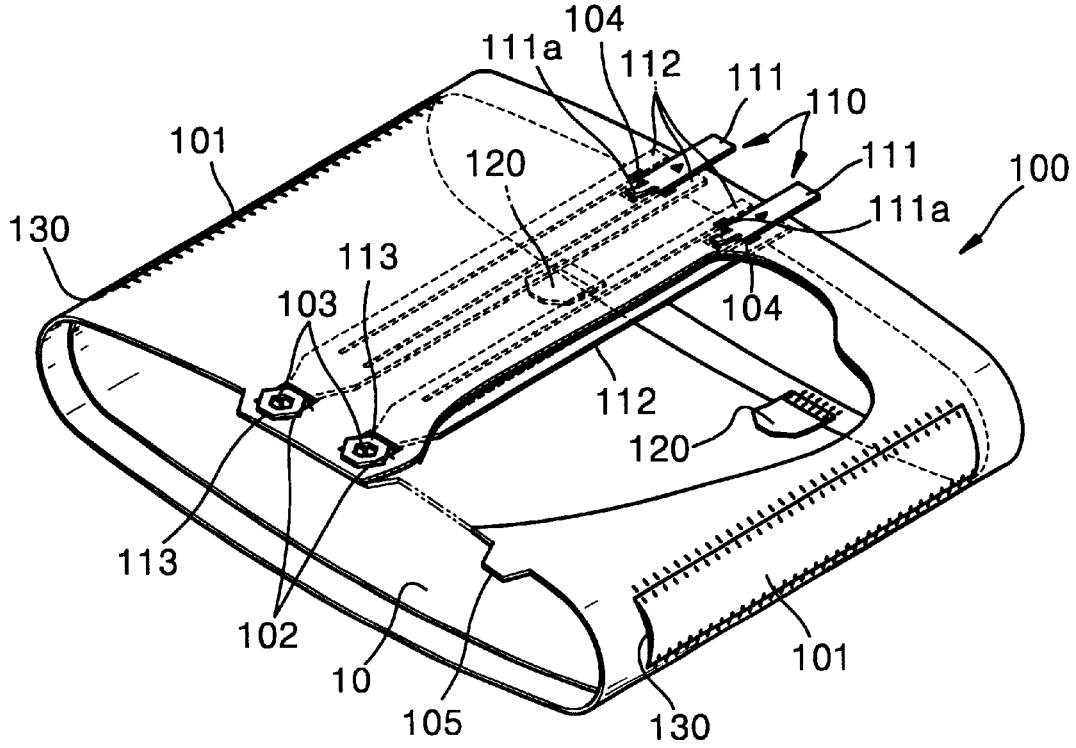
FIG. 5 is a perspective view illustrating a soft cartridge of the photosensitive belt cartridge shown in FIG. 4 in an expanded state.
Figure 6:
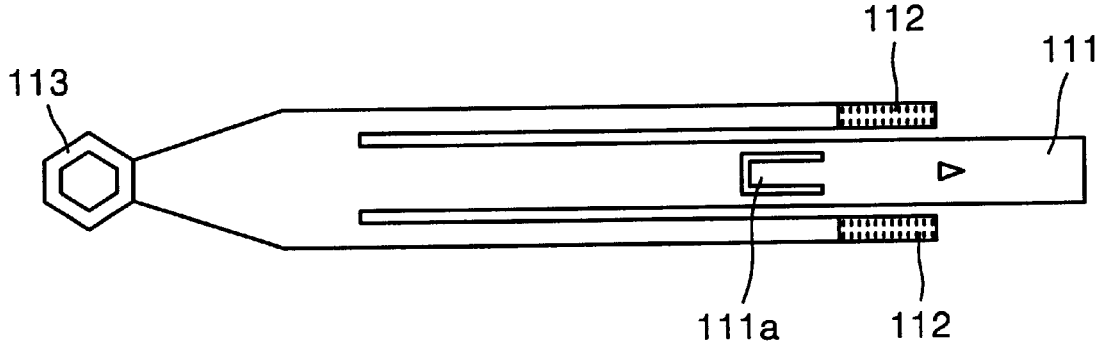
Figure 7:
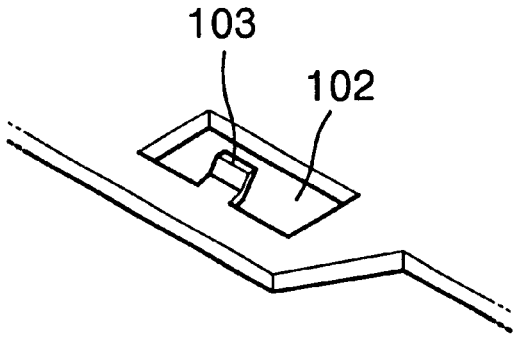
Figure 8:
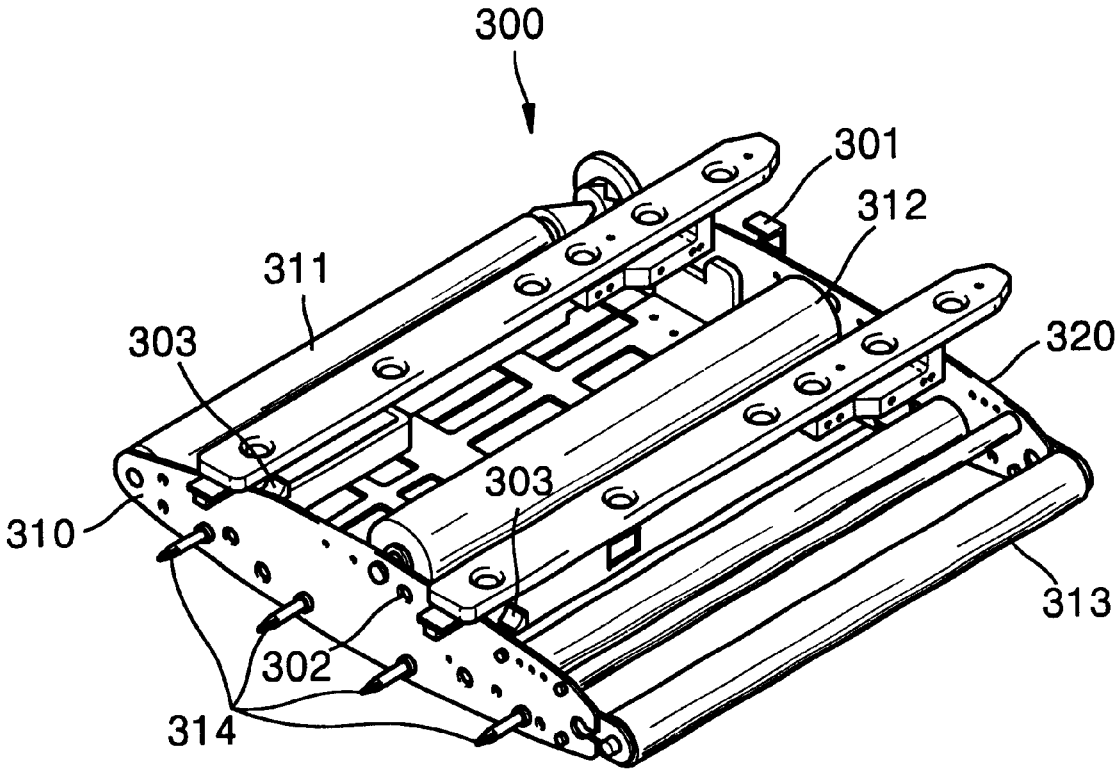
Figure 9:
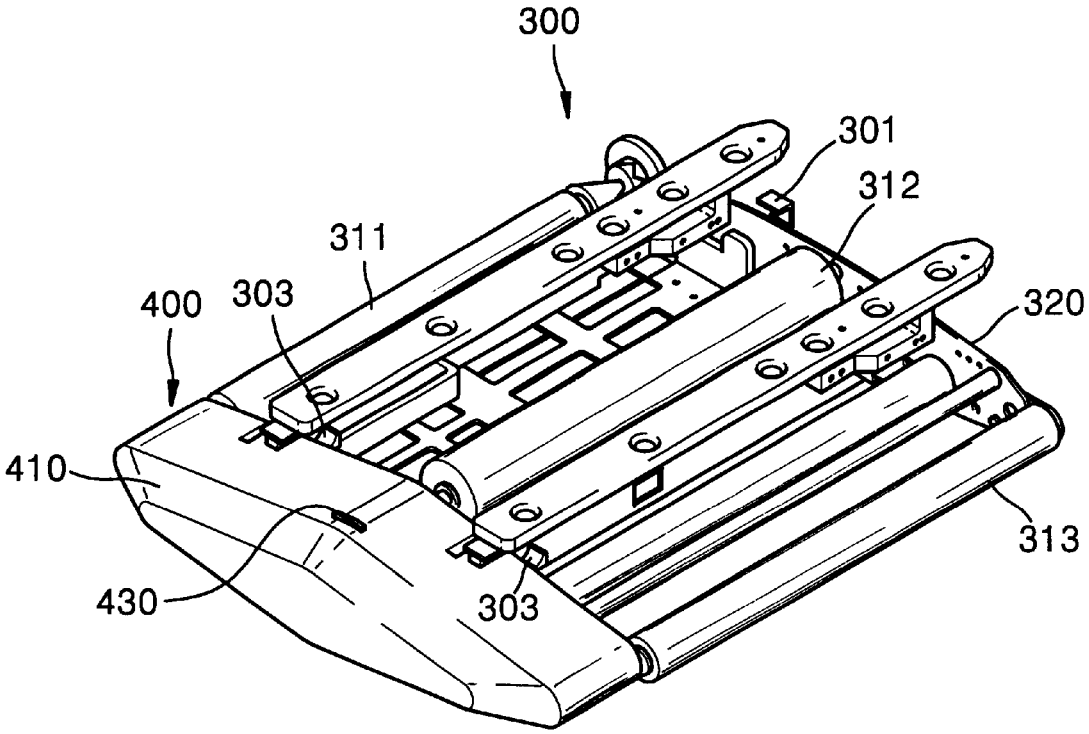
Figure 10:
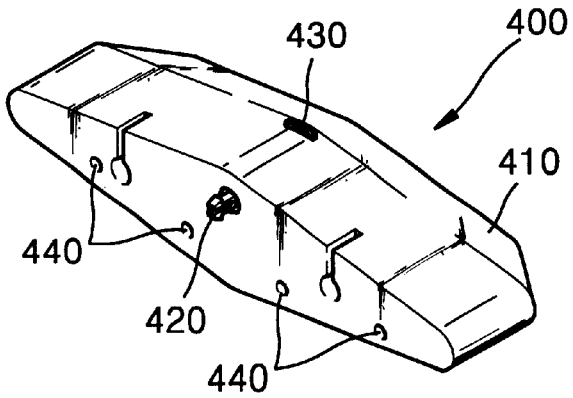
Figure 11:
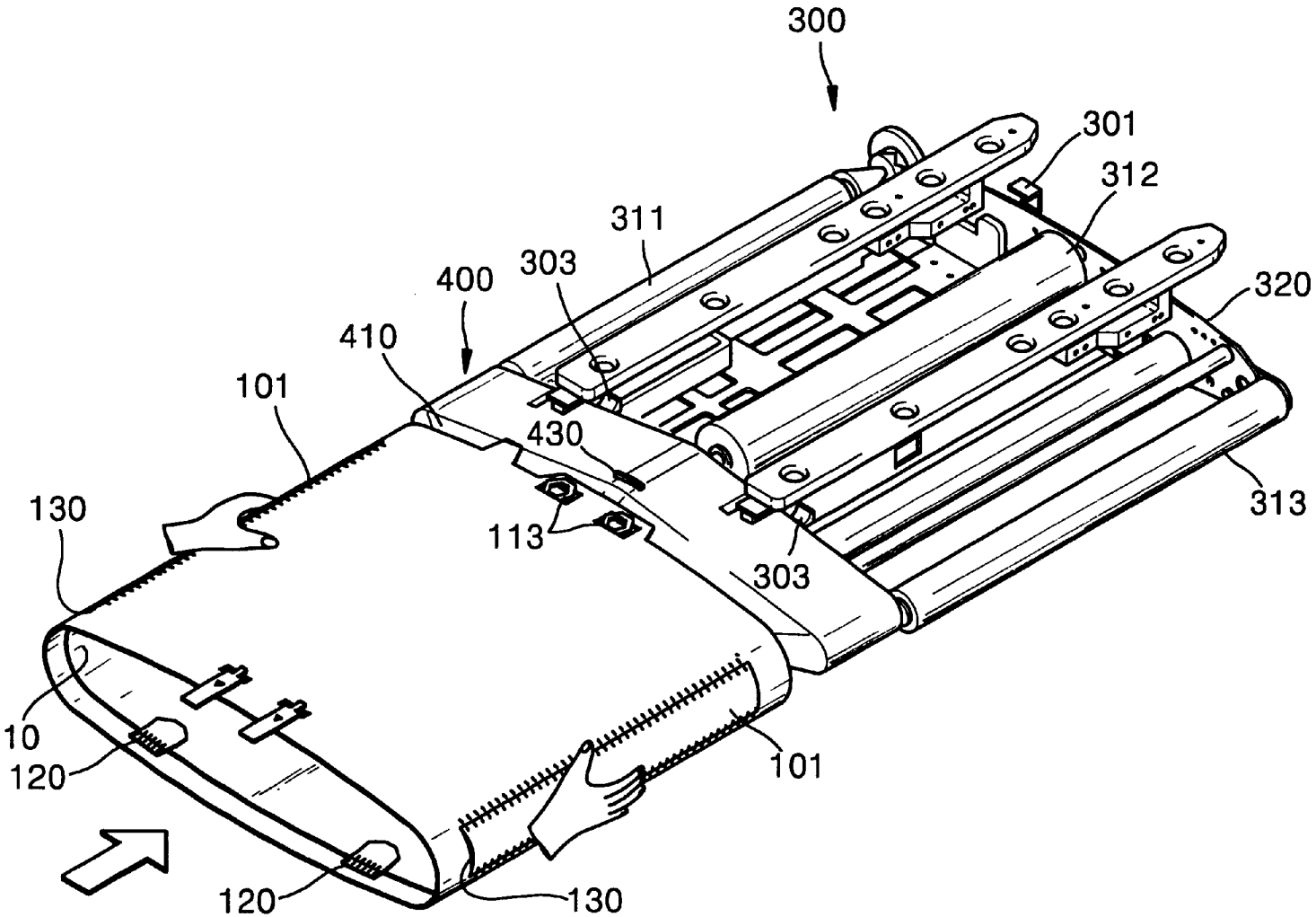
Figure 12:
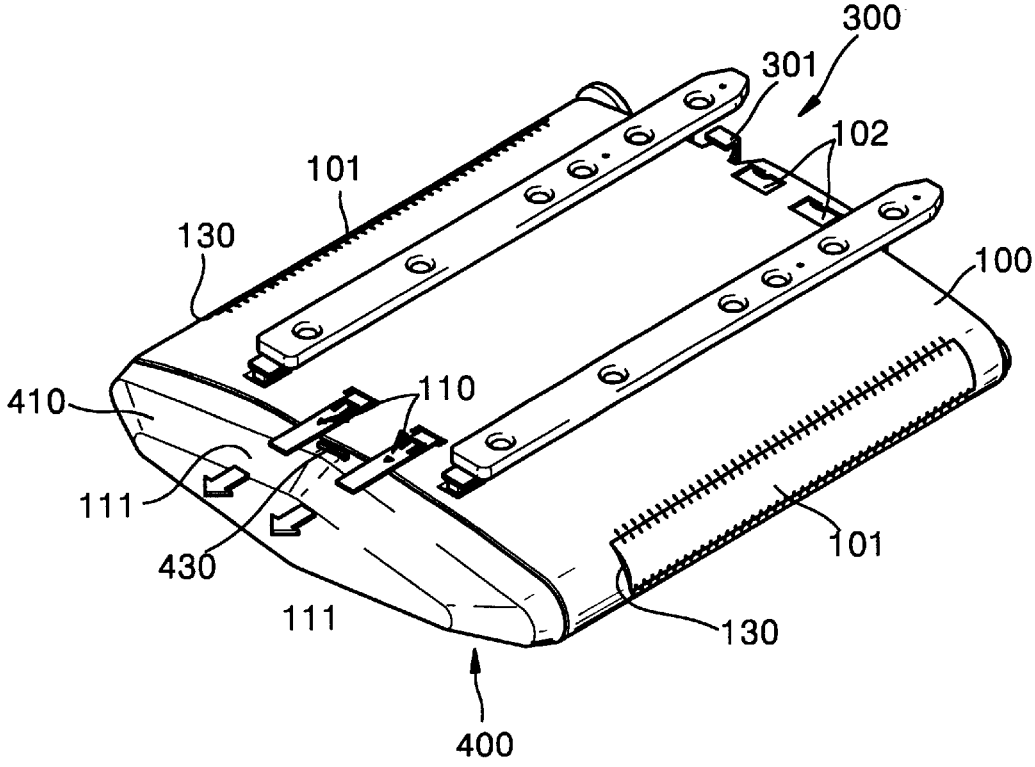
Figure 13:
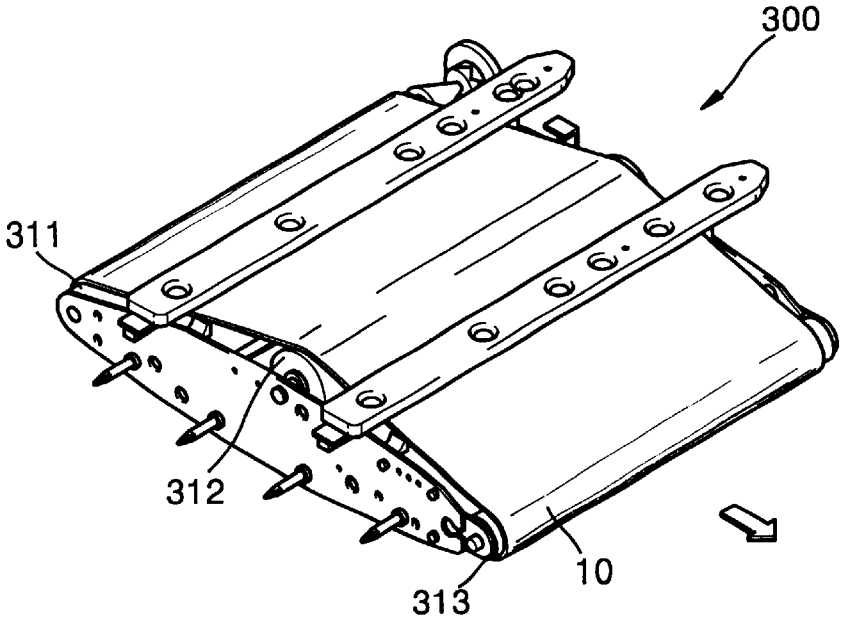

FIR. 6 is a plan view illustrating a band member of the photosensitive belt cartridge shown in FIG. 4;

FIG. 7 is a perspective view illustrating an engagement-hole portion of the photosensitive belt cartridge shown in FIG. 4, into which an engagement portion of the band member shown in FIG. 6 is inserted;

FIG. 8 is a perspective view illustrating a belt unit around which a photosensitive belt is installed;

FIG. 9 is a perspective view illustrating the belt unit of FIG. 8 to which an installation guide member is installed;

FIG. 10 is a perspective view illustrating the installation guide member shown in FIG. 9;

FIG. 11 is a perspective view illustrating the operation of fitting the soft cartridge of FIG. 5 to the belt unit of FIG. 8;

FIG. 12 is a perspective view illustrating the belt unit to which the soft cartridge has been fitted; and FIG. 13 is a perspective view illustrating the belt unit around which the photosensitive belt has been installed after the soft cartridge with the soft cartridge removed.

DESCRIPTION OF THE PREFERRED EMBODIMENTS

FIGS. 4 and 5 show the structure of a photosensitive belt cartridge of an electrophotographic image forming apparatus according to the present invention. As shown in FIGS. 4 and 5, a photosensitive belt cartridge according to the present invention includes a cylindrical hard cartridge 200, and a soft cartridge 100 receiving a photosensitive belt 10 and stored in the hard cartridge 200 in a rolled-up state.

The soft cartridge 100 is made of a flexible material such as polyethylene film or PVC film, and is not plastically deformed even though it is rolled up as shown in FIG. 4. Therefore, when an external force is removed, the soft cartridge 100 is restored back to its original shape, and expands as shown in FIG. 5. The expanded shape thereof is the endless track shape of a belt unit with its sides open. The photosensitive belt 10 is also received in the soft cartridge 100 in the same endless track shape as when the photosensitive belt 10 is installed around the belt unit within the image forming apparatus. To this end, a plurality of band members 110 and hooking pieces 120 are provided as restricting means and auxiliary restricting means. Since the band members 110 and the hooking pieces 120 can be rolled up when the soft cartridge 100 is rolled up, it is preferable that they are made of the same material as that of the soft cartridge 100.

The band member 110 is split into three branches at one end, and is integrally connected at the other end, as shown in FIGS. 5 and 6. In addition, a hexagonal engagement portion 113 is formed at the top end of the other end. The end portions of both outer branches 112 of the three branches are fixed to the upper inner wall surface of the soft cartridge 100. The center branch 111 is passed through a slit 104 of the soft cartridge 100 and extends along the outer wall of the soft cartridge 100. Reference numeral 111 a denotes a cut portion formed so that the cut portion 111 a can hook on the slit 104, and the center branch 111 can be prevented from escaping from the slit 104. Both the outer branches 112 are called fixed branches and the center branch 111 is called a movable branch. In addition, the engagement portion 113 at the other end of the band member 110 is elastically inserted into an engagement hole 102 formed at the side edge portion of the soft cartridge 100 positioned across the soft cartridge 100 from the slit 104 so that the band member 110 can extend across the upper inner wall of the soft cartridge 100. That is, since the distance between two opposing angular points of the hexagonal engagement portion 113 is set to be longer than the width of the engagement hole 102, the engagement portion 113 is elastically bent while inserted into the engagement hole 102, and is expanded back to fix itself in place after passing through the engagement hole 102.

On the other hand, when the band member 110 is strongly pulled out, the engagement portion 113 is caused to escape from the engagement hole 102. Reference numeral 103 denotes a stopper piece for preventing the engagement portion 113 from easily escaping from the engagement hole 102 due to even a small shock after the engagement portion 113 is inserted into the engagement hole 102, and the free end of the stopper piece 103 is bent upward, as shown in FIG. 7. A reason why the free end of the stopper piece 103 is bent upward is to prevent the stopper piece 103 from hooking the photosensitive belt 10 within the soft cartridge 100 when the soft cartridge 100 is pulled out from the belt unit 300.

The photosensitive belt 10 is disposed between the band member 110 and the inner wall of the soft cartridge 100 configured as described above. That is, two upper portions of the photosensitive belt 10 are supported by the two band members 110 extending across the inner wall of the soft cartridge 100 so as not to be loosened in a downward direction (i.e., away from inner wall).

The hooking pieces 120 are installed at the lower inner wall of the soft cartridge 100. One end of each hooking piece 120 is fixed to the inner wall of the soft cartridge 100, and the other end is a non-fixed end, i.e., a free end, and is bent to contact the inner wall of the soft cartridge 100. Two edge portions of the lower portion of the photosensitive belt 10 are inserted, via the free ends of the hooking pieces 120, and are supported between the hooking pieces 120 and the inner wall of the soft cartridge 100.

Consequently, the photosensitive belt 10 is supported by the band members 110 which are restricting means, and the hooking pieces 120 which are auxiliary restricting means, in the endless track shape within the soft cartridge 100.

In addition, reference numeral 130 denotes a high strength member made of a relatively high strength material such as stainless steel. Each high strength member 130 is inserted into a bag 101, preferably provided at opposite side surfaces along a width of the soft cartridge 100. Each high strength member is shaped to have the same curvature as that of the side surfaces of the soft cartridge 100. These high strength members 130 assist the soft cartridge 100 in maintaining the endless track shape by causing the curvature of both the side surfaces of the soft cartridge 100 to be maintained. Preferably, the high strength members 130 are installed so that a user can carry the soft cartridge 100 while holding portions of the high strength members 130, and so that the user can hold the portions of the high strength members 130 while inserting the soft cartridge 100 around the belt unit 300 to install the photosensitive belt 10.

In addition, reference numeral 105 denotes a projection to be detected by a sensor 301 (FIG. 8). The projection 105 is provided so that the sensor 301 provided at the belt unit can sense the projection 105 and inform the user of the completion of the insertion of the soft cartridge 100, when the soft cartridge 100 is inserted into the image forming apparatus.

As shown in FIG. 4, such a soft cartridge 100 is rolled up and stored in the hard cartridge 200 until the soft cartridge 100 is used while containing the received photosensitive belt 10 therein. As a result, since the soft cartridge 100 is stored in the cylindrical hard cartridge 200 in a rolled-up state, the space occupied by the hard cartridge 200 can be much smaller than that required when the photosensitive belt 10 is conventionally stored on a cartridge in the fully expanded volume of the endless track shape.

When the photosensitive belt 10 is required to be installed, the soft cartridge 100 receiving the photosensitive belt 10 is pulled out from the hard cartridge 200 after removing a cap 210 of the hard cartridge 200. Then, the soft cartridge 100 expands back as shown in FIG. 5.

As shown in FIG. 8, a plurality of rollers including three main supporting rollers 311, 312 and 313 are installed between a front frame 310 and a rear frame 320 in a belt unit 300 around which the photosensitive belt 10 is to be installed. The photosensitive belt 10 circulates around the endless track while supported by the rollers. Reference numeral 314 denotes the shafts of the rollers besides the main rollers 311, 312, and 313, which support the lower portion of the photosensitive belt 10, and the shafts 314 extend and project in front of the front frame 310.

In order to install the photosensitive belt 10, first, an installation guide member 400 is installed at the front frame 310 of the belt unit 300, as shown in FIG. 9. The installation guide member 400 has a connection hook 420 which is elastically fitted to a connection hole 302 (FIG. 8) of the front frame 310, as shown in FIGS. 9 and 10, and has a sloping surface 410 which gradually enlarges in a direction from the outside of the image forming apparatus to the belt unit 300. The sloping surface 410 is formed in consideration of possible drooping of the soft cartridge 100 on the open side since the soft cartridge 100 is flexible as described above. Therefore, although the soft cartridge 100 droops on the open side, the soft cartridge 100 is easily fitted to the belt unit 300 along the sloping surface 410, and is gradually spread by the sloping surface 410 to restore its original endless track shape while pushed on around the belt unit 300. Reference numeral 440 denotes holes for receiving the shafts 314 of the above rollers, and reference numeral 430 denotes a marking projection for guiding the position of completion of the pushing operation of the soft cartridge 100 around the belt unit 300.

After the installation guide member 400 as described above is installed at the front frame 310 of the belt unit 300, the soft cartridge 100 taken out from the hard cartridge 200 is pushed on around the belt unit 300 as shown in FIG. 11. At this time, when the user holds both sides of the soft cartridge 100 at which the high strength members 130 are installed, and pushes the soft cartridge 100 on around the belt unit 300, the open side of the soft cartridge 100 is gradually spread along the sloping surface 410 of the installation guide member 400, and is fitted to the belt unit 300. The soft cartridge 100 is pushed on until the rear edge of the soft cartridge 100 is aligned with the marking projection 430 formed on the installation guide member 400. At this moment, the projection 105 (FIG. 5) is sensed by the sensor 301, and the sensor 301 generates a signal for informing the user of the completion of the pushing operation of the soft cartridge 100.

When the pushing operation of the soft cartridge 100 is completed as shown in FIG. 12, the user holds the movable branches 111 of the two band members 110 and pulls the movable branches 111 in the direction of arrows. Then, the engagement portions 113 of the band members 110 are pulled out from the respective engagement holes 102, and accordingly, the photosensitive belt 10 hung over and supported by the band members 110 is seated around the rollers including the main supporting rollers 311, 312, and 313 of the belt unit 300. The triangle symbols marked on the movable branches 111 are intended for guiding the position of pulling the band members 110. When the band members 110 are pulled until the symbols reach the edge of the soft cartridge 100, the engagement portions 113 are completely pulled out from the engagement holes 102.

In this state, when the soft cartridge 100 is again pulled out from the belt unit 300, the photosensitive belt 10 remains around the belt unit 300 and only the soft cartridge 100 is pulled away from the belt unit 300. Since the belt unit 300 is provided with belt stoppers 303, the belt stoppers 303 interfere with the photosensitive belt 10 so that the photosensitive belt 10 can not be pulled out together with the soft cartridge 100 when the soft cartridge 100 is pulled out from the belt unit 300.

As described above, after the soft cartridge 100 is pulled out, the installation guide member 400 is removed, and the installation of the photosensitive belt 10 is completed when the roller 313 is moved in the direction of the arrow shown in FIG. 13, making the photosensitive belt 10 tightly tensioned.

In addition, it is preferable that the thickness of the material of the soft cartridge 100 is set to be about 0.15~0.25 mm. When the thickness is too thin, the endless track shape cannot be maintained and the soft cartridge 100 easily droops, and when the thickness is too thick, it is difficult to roll up the soft cartridge 100. Therefore, to make the thickness be about 0.15~0.25 mm is advantageous for storing the soft cartridge 100 and performing the installation operation of the photosensitive belt 10.

In addition, if light passes through the soft cartridge 100, the photosensitive belt therein may be damaged. Therefore, it is preferable that the color of the soft cartridge 100 is an opaque color such as a black color.

As described above, when the operation of replacing a photosensitive belt is performed by employing the photosensitive belt cartridge of an electrophotographic image forming apparatus and the photosensitive belt installation device according to the present invention, since the soft cartridge can be stored in the hard cartridge in a rolled-up state before the installation, and can be expanded when installed, the space required for storing the photosensitive belt can be considerably reduced. In addition, since the soft cartridge is simply pushed on around the belt unit and is simply pulled out from the belt unit by using the installation guide member when the photosensitive belt is installed, the replacing operation of the photosensitive belt can be performed in a very convenient and fast manner.

It is contemplated that numerous modifications may be made to the present invention without departing from the spirit and scope of the invention as defined in the following claims. For example, the engagement portion may have shapes other than hexagonal (e.g., polygonal, circular, and/or having different interior and exterior shapes).

What is claimed is:

1. A photosensitive belt cartridge of an electrophotographic image forming apparatus comprising:

a soft cartridge which has an endless track shape of a belt unit of the image forming apparatus, which receives a photosensitive belt therein in the endless track shape, which is flexible and is rolled up for storage, and which restores back to the endless track shape when an external force applied for storage is removed.

2. The photosensitive belt cartridge of an electrophotographic image forming apparatus as claimed in claim 1, wherein the soft cartridge rolls up for storage with the photosensitive belt received therein.

3. The photosensitive belt cartridge of an electrophotographic image forming apparatus as claimed in claim 1, further comprising a hard cartridge in which said soft cartridge is stored in the rolled-up state.

4. The photosensitive belt cartridge of an electrophotographic image forming apparatus as claimed in claim 1, wherein the soft cartridge is made of a material selected from the group consisting of polyethylene film and PVC film.

5. The photosensitive belt cartridge of an electrophotographic image forming apparatus as claimed in claim 4, wherein the thickness of the material of the soft cartridge is 0.15~0.25 mm.

6. The photosensitive belt cartridge of an electrophotographic image forming apparatus as claimed in claim 1, wherein the soft cartridge further comprises a restricting means for restricting the photosensitive belt received therein in a direction to cause the photosensitive belt to closely contact an inner wall of the soft cartridge, and for freeing the photosensitive belt from the restricted state when the photosensitive belt is installed around a belt unit within the image forming apparatus.

7. The photosensitive belt cartridge of an electrophotographic image forming apparatus as claimed in claim 6, wherein the restricting means includes a band member which is disposed in a width direction of the soft cartridge, wherein a first end portion of the band member is fixed to a first edge of the soft cartridge, wherein a second end portion of the band member is removably joined to an engagement hole provided at a second edge of the soft cartridge, which is an edge of the soft cartridge across from the first edge, and wherein the photosensitive belt, when received by said soft cartridge, is hung over and supported by the band member.

8. The photosensitive belt cartridge of an electrophotographic image forming apparatus as claimed in claim 7, wherein said first end portion of the band member comprises:

at least one fixed branch fixed to the first edge at the inner wall of the soft cartridge; and a movable branch which passes through a slit formed at the first edge of the soft cartridge, from an inner side of the soft cartridge to an outer side of the soft cartridge, and which extends along an outer wall of the soft cartridge after passing through the slit, wherein said second end portion of the band member releases from the engagement hole when the movable branch is pulled out.

9. The photosensitive belt cartridge of an electrophotographic image forming apparatus as claimed in claim 7, wherein the band member is made of a material selected from the group consisting of polyethylene film and PVC film.

10. The photosensitive belt cartridge of an electrophotographic image forming apparatus as claimed in claim 6, wherein the soft cartridge rolls up for storage with the photosensitive belt received therein; and wherein the soft cartridge further comprises auxiliary restricting means for restraining the photosensitive belt from being separated from the soft cartridge, while the photosensitive belt is stored, by pressing an edge portion of the photosensitive belt against the inner wall of the soft cartridge, wherein said restricting means are installed at an upper portion of the soft cartridge, and wherein said auxiliary restricting means are installed at the lower portion of the soft cartridge.

11. The photosensitive belt cartridge of an electrophotographic image forming apparatus as claimed in claim 10, wherein the auxiliary restricting means includes a hooking piece having a fixed end and a free end, said fixed end being fixed to the inner wall of the lower portion of soft cartridge so that the edge portion of the photosensitive belt is inserted and supported between said free end of the hooking piece and the inner wall of the soft cartridge.

12. The photosensitive belt cartridge of an electrophotographic image forming apparatus as claimed in claim 1, wherein high strength members having a shape compatible with a curvature of corresponding portions of the endless track shape of the belt unit are installed at opposite side surfaces of the soft cartridge along a width direction.

13. The photosensitive belt cartridge of an electrophotographic image forming apparatus as claimed in claim 1, wherein the color of the soft cartridge is an opaque color which does not pass light.

14. A photosensitive belt installation device of an electrophotographic image forming apparatus for assisting the installation of a photosensitive belt around a belt unit within the image forming apparatus comprising:

an installation guide member which is attached to a front frame of the belt unit when the photosensitive belt is installed, and has a sloping surface gradually enlarging in a direction from an outside of the image forming apparatus to the belt unit; and a soft cartridge which is a flexible cartridge having a shape of an endless track of the belt unit, which is open on both sides, in which the photosensitive belt to be installed around the belt unit is supported by predetermined restricting means in the endless track shape, and which is shaped so that one open side of the soft cartridge is fits over the sloping surface of the installation guide member, wherein the sloping surface guides the soft cartridge onto the belt unit during installation of the photosensitive belt around the belt unit, wherein, when the soft cartridge is completely pushed around the belt unit and is then pulled out from the belt unit, the predetermined restricting means frees the photosensitive belt received in the soft cartridge, wherein the photosensitive belt remains around the belt unit.

15. The photosensitive belt installation device of an electrophotographic image forming apparatus as claimed in claim 14, wherein the installation guide member further comprises a marking projection indicating an edge position of the soft cartridge, wherein the marking projection is for indicating the edge position of the soft cartridge when the soft cartridge is completely pushed around the belt unit.

16. The photosensitive belt installation device of an electrophotographic image forming apparatus as claimed in claim 14, wherein the belt unit is provided with at least one belt stopper which causes the photosensitive belt not to be pulled out together with the soft cartridge by interfering with an outer edge of the photosensitive belt when the soft cartridge is pulled out from the image forming apparatus.

17. A photosensitive belt installation method of an electrophotographic image forming apparatus for installing a photosensitive belt around a belt unit within the image forming apparatus including the steps of:

preparing a soft cartridge which is a flexible cartridge having a shape of an endless track of the belt unit and open on both sides, and in which the photosensitive belt to be installed around the belt unit is supported by predetermined restricting means in the endless track shape;

installing an installation guide member, which has a sloping surface gradually enlarging in a direction from an outside of the image forming apparatus to the belt unit, at the front frame of the belt unit;

fitting one open side of the soft cartridge to the sloping surface of the installation guide member, and completely pushing the soft cartridge around the belt unit along the sloping surface; and causing the photosensitive belt received in the soft cartridge to remain around the belt unit by pulling out the soft cartridge from the image forming apparatus after the photosensitive belt is freed from a restricted state by the restricting means.

* * * * *